US007303070B1

(12) United States Patent
Hong

(10) Patent No.: US 7,303,070 B1
(45) Date of Patent: Dec. 4, 2007

(54) PARTITIONED GOLF CLUB BAG

(76) Inventor: Kwangill Hong, 13704 Osborne St., Arleta, CA (US) 91331

( * ) Notice: Subject to any disclaimer, the term of this patent is extended or adjusted under 35 U.S.C. 154(b) by 0 days.

(21) Appl. No.: 11/446,716

(22) Filed: Jun. 5, 2006

(51) Int. Cl.
*A63B 55/00* (2006.01)
*A63B 55/06* (2006.01)
*A63B 55/08* (2006.01)

(52) U.S. Cl. ..... 206/315.6; 206/316.3; 206/315.7; 211/70.2; 248/96

(58) Field of Classification Search ..... 206/315.3, 206/315.5–315.7; 248/96; 280/DIG. 6; 211/70.2
See application file for complete search history.

(56) References Cited

U.S. PATENT DOCUMENTS

| | | | | | |
|---|---|---|---|---|---|
| 1,417,380 | A | | 5/1922 | Hatch | |
| 1,727,612 | A | * | 9/1929 | Lescher | 248/96 |
| 1,731,588 | A | | 10/1929 | Patterson | |
| 1,978,230 | A | * | 10/1934 | Schutes | 248/96 |
| 2,064,433 | A | * | 12/1936 | Kronthal | 211/70.2 |
| 2,324,439 | A | * | 7/1943 | Thommen | 248/96 |
| 2,607,382 | A | * | 8/1952 | Le Vine | 206/315.6 |
| 2,722,258 | A | * | 11/1955 | Smidt et al. | 206/315.6 |
| 2,860,679 | A | * | 11/1958 | Kouke | 211/70.2 |
| 3,101,108 | A | * | 8/1963 | Ingoldt | 206/315.2 |
| 4,332,283 | A | * | 6/1982 | Rader | 206/315.6 |
| 4,944,396 | A | * | 7/1990 | Larkin | 206/315.6 |
| 5,082,218 | A | * | 1/1992 | Hoffman | 248/96 |
| 5,094,345 | A | * | 3/1992 | Yonnetti | 206/315.2 |
| 5,135,107 | A | * | 8/1992 | Ingraham | 206/315.6 |
| 5,279,414 | A | | 1/1994 | Brasher | |
| 5,356,003 | A | * | 10/1994 | Gretz et al. | 206/315.7 |
| 5,383,555 | A | | 1/1995 | Weinmeier | |
| 5,518,113 | A | | 5/1996 | Boone | |
| 5,573,122 | A | * | 11/1996 | Williams | 211/70.2 |
| 5,671,842 | A | * | 9/1997 | Jaworski | 206/315.3 |
| 5,755,322 | A | | 5/1998 | Yang | |
| 5,829,585 | A | * | 11/1998 | Kao et al. | 206/315.3 |
| 5,853,086 | A | | 12/1998 | Chang | |
| 5,860,520 | A | | 1/1999 | Tang | |
| 5,884,780 | A | | 3/1999 | Cho | |
| 6,023,225 | A | | 2/2000 | Boley et al. | |
| 6,102,202 | A | * | 8/2000 | Jones | 206/315.6 |
| 6,298,987 | B1 | * | 10/2001 | Clark | 206/315.6 |
| 6,712,205 | B2 | * | 3/2004 | Lee | 206/315.5 |
| 6,774,792 | B1 | | 8/2004 | Williams | |
| 6,988,738 | B2 | * | 1/2006 | Lu | 280/47.26 |

* cited by examiner

*Primary Examiner*—Sue A. Weaver
(74) *Attorney, Agent, or Firm*—Albert O. Cota

(57) ABSTRACT

A partitioned golf club bag (10) having a partitioned golf club insert (26) that includes an upper partitioned platform (28) having fourteen golf club bores (36). Each golf club bore (36) is marked with a number (86) that corresponds to the number of a particular golf club (170). Into each golf club bore (36) is inserted a golf club sleeve (78) that includes a vertical notch (82) that maintains each golf club (170) in an orderly, angular position. The golf club bag (10) also includes a shoulder harness (142), a plurality of utility pockets (158), and an articulated, combination golf bag stand and wheel assembly (90). The assembly (90) can be positioned to allow the golf club bag (12) to be placed in a stationary position or to be placed in a position that allows the golf club bag (12) to be pushed or pulled by means of a handle (156) that is attached to the golf club bag (12).

10 Claims, 4 Drawing Sheets

PARTITIONED GOLF CLUB BAG

TECHNICAL FIELD

The invention generally pertains to golf club bags, and more particularly to a golf club bag that includes a partitioned golf club insert, various accessory pockets and means for rolling or carrying the partitioned golf club bag.

BACKGROUND ART

One of the most popular sports today is golf, which is played amateurly or professionally throughout the world by many men, women and children. Typically, a golfer will utilize a set of fourteen golf clubs which are inserted into a golf bag that is rolled or carried by the golfer or a caddie. During the course of a golf game, the golfer or caddie will select a golf club that is best suited for striking a golf ball the distance required for a particular hole.

The problem with currently available golf bags is that it is often difficult to select and extract a particular golf club as a result of all fourteen golf club being co-mingled within the golf bag.

The instant invention not only individually partitions each of the golf clubs, but also includes a partitioned insert that indicates the number of each golf club. Additionally, the partitioned insert includes a sleeve that maintains each golf club head in an optimum position for viewing the club number and for grasping and extracting the golf club from the golf bag.

A search of the prior art did not disclose any literature or patents that read directly on the claims of the instant invention. However, the following U.S. patents are considered related:

| U.S. PAT. NO. | INVENTOR | ISSUED |
|---|---|---|
| 6,774,792 | Williams | 10 Aug. 2004 |
| 5,518,113 | Boone | 21 May 1996 |
| 5,279,414 | Brasher | 18 Jan. 1994 |

The U.S. Pat. No. 6,774,792 discloses a system for detecting the presence of individual golf clubs in a golf bag. The system comprises a club monitoring device mountable in the interior of the golf bag that may include a pressure sensitive mat for positioning on the bottom of the interior of the golf club bag. The pressure sensitive mat includes pressure sensing apparatus for sensing pressure applied to the upper surface of the pressure sensitive mat by the weight of one or more golf clubs. A control unit coupled to the pressure sensing apparatus indicates when a golf club is removed from the pressure sensitive mat.

The U.S. Pat. No. 5,518,113 discloses a golf club bag having a divider top. The top is adapted to receive golf clubs in a manner that distributes the golf clubs within the bag to balance the distribution of the weight, thereby providing a stable center of gravity throughout the bag. The golf bag includes a golf club chamber which has a rectangular configuration with a golf club divider at the top that divides and separates the golf clubs into a plurality of golf club holding sections.

The U.S. Pat. No. 5,279,414 discloses a golf club bag which accommodates golf clubs with the club heads down, providing a central hollow core element positioned within the length of the bag. The element includes a central elongated central core, and an outer club area between the core element wall and the outer wall of the bag. The outer club area is divided into a plurality of club spaces formed by a plurality of spaced-apart wall partitions, so that an iron club can be placed in a protected position within each partitioned area.

For background purposes and as indicative of the art to which the invention relates, reference may be made to the following remaining patents found in the search:

| U.S. PAT. NO. | INVENTOR | ISSUED |
|---|---|---|
| 6,023,225 | Boley, et al | 8 Feb. 2000 |
| 5,884,780 | Cho | 23 Mar. 1999 |
| 5,860,520 | Tang | 19 Jan. 1999 |
| 5,853,086 | Chang | 29 Dec. 1998 |
| 5,755,322 | Yang | 26 May 1998 |
| 5,383,555 | Weinmeier | 24 Jan. 1995 |
| 1,731,588 | Patterson | 15 Oct. 1929 |
| 1,417,380 | Hatch | 23 May 1992 |

DISCLOSURE OF THE INVENTION

The partitioned golf club bag (PGCB) is designed to:

1. provide a golfer with a golf club bag that is easily carried, rolled or placed in a stationary position, and 2. allow a set of golf clubs to be placed into a golf bag in orderly positions and to be easily inserted and removed from the golf bag.

In its basic design configuration, the PGCB utilizes an elongated-circular shaped golf club bag having a first side half and a second side half. The first side half has attached a handle and an articulated, combination golf club bag stand and wheel assembly. The second side half has attached a shoulder harness, a plurality of utility pockets and a lower flap. The PGCB also includes a partitioned golf club insert that is inserted into the golf club bag.

The combination golf bag stand and wheel assembly is designed to be placed in either a stowed position, which is flat against the side of the golf club bag, as in an outward extended position. The assembly has a right leg and a left leg that each terminate with an outward-extending axle. Each axle includes means for rapidly and easily attaching and detaching respectively a right wheel and a left wheel. When the wheels are preferably not attached, and the assembly is placed in the extended position, the two axles function respectively as a right and left golf bag stand. Conversely, when the assembly is in the stowed position and the two wheels are attached, the golf club bag can be grasped by the handle and the bag rolled or pushed.

The partitioned golf club insert has an upper partitioned platform having a set of fourteen numbered golf club bores, and a lower partitioned platform also having fourteen golf club bores that are in alignment with the golf club bores on the upper partitioned platform. The two platforms are connected by a set of at least three evenly-spaced longitudinal support members that are attached to the two platforms by screws or an adhesive.

The PGCB can also be designed to include a set of fourteen golf club sleeves that are inserted into each of the bores on the upper and lower partitioned platform prior to inserting a golf club. Each sleeve is height-staggered and has an upper opening and a lower end. The upper opening is located above the upper surface of the upper platform, and the lower end rests upon the lower surface of the golf club bag. The sleeve includes on its upper opening a vertical notch that allows the head of an inserted golf club to be placed and maintained in a particular angular position. The sleeves can also include a strap-attached cap that is dimensioned to frictionally fit over the sleeve's upper opening when a golf club is not inserted into the sleeve.

In view of the above disclosure, the primary object of the invention is to produce a PGCB that is easily pushed, rolled and carried, and that allows a set of up to fourteen golf clubs to be orderly arranged and easily inserted and removed from the golf club bag.

In addition to the primary object of the invention it is also an object of the invention to produce a PGCB that:

- is configured and dimensioned to accommodate metal or wood golf clubs,
- positions each golf club for easy identification and extraction,
- provides a partitioned golf club insert that adds very little weight to the golf club bag,
- allows the partitioned golf club insert can be inserted into a standard golf bag, and
- is cost effective from both a consumer's and manufacture's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
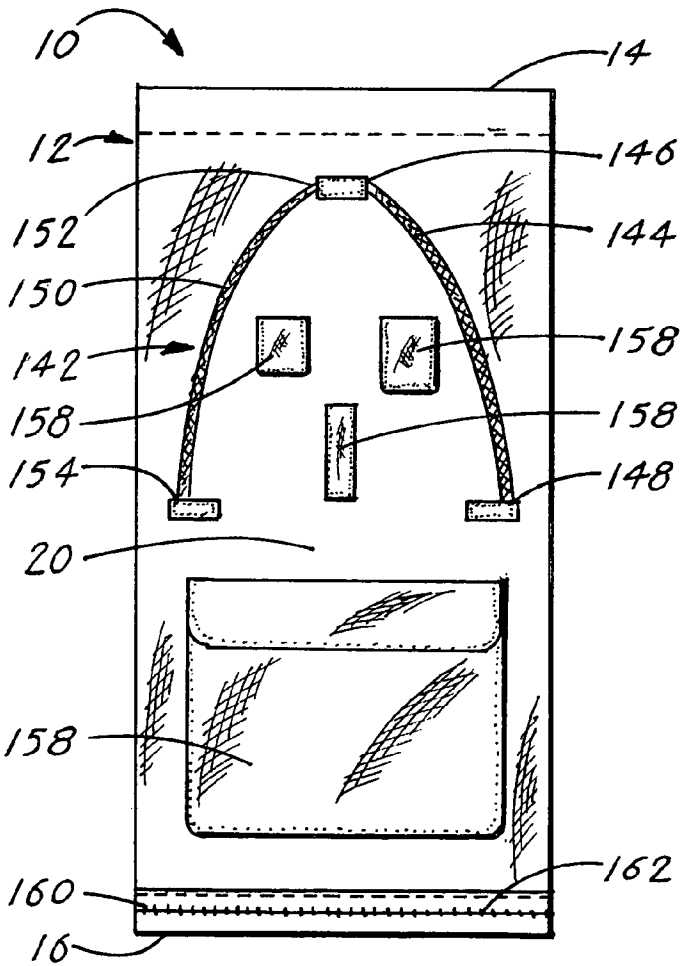
FIG. 2 is an elevational view showing a shoulder strap and a plurality of utility pockets attached to the second side half of the partitioned golf club bag.

The best mode for carrying out the invention is presented in terms of a preferred embodiment for a partitioned golf club bag 10 (hereinafter "PGCB 10"). The PGCB 10 in the preferred embodiment, as shown in FIGS. 1-9, is comprised of the following major elements: a golf club bag 12, a partitioned golf club insert 26, a golf club sleeve 78, and an articulated, combination golf bag stand and wheel assembly 90.

Figure 1:
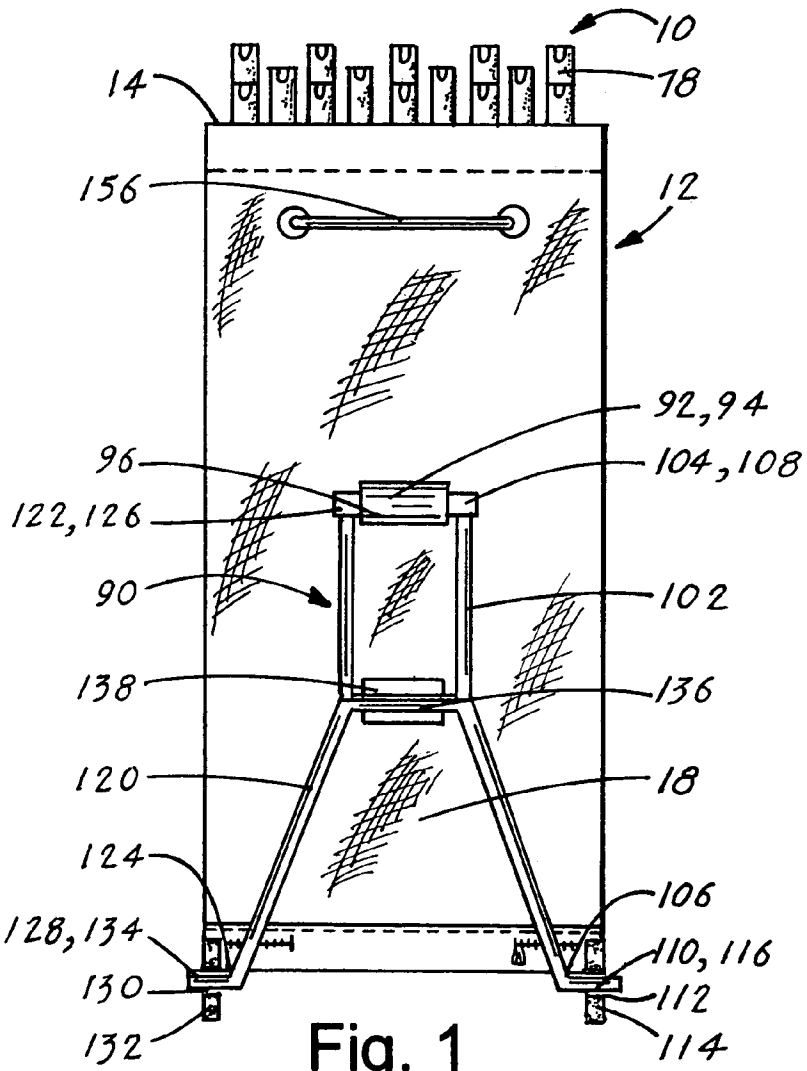
FIG. 1 is an elevational view showing a handle and an articulated combination golf bag stand and wheel assembly attached to the first side half of the partitioned golf club bag. The figure also shows a set of fourteen height-staggered golf club sleeves.
Figures 3, 4, 5:
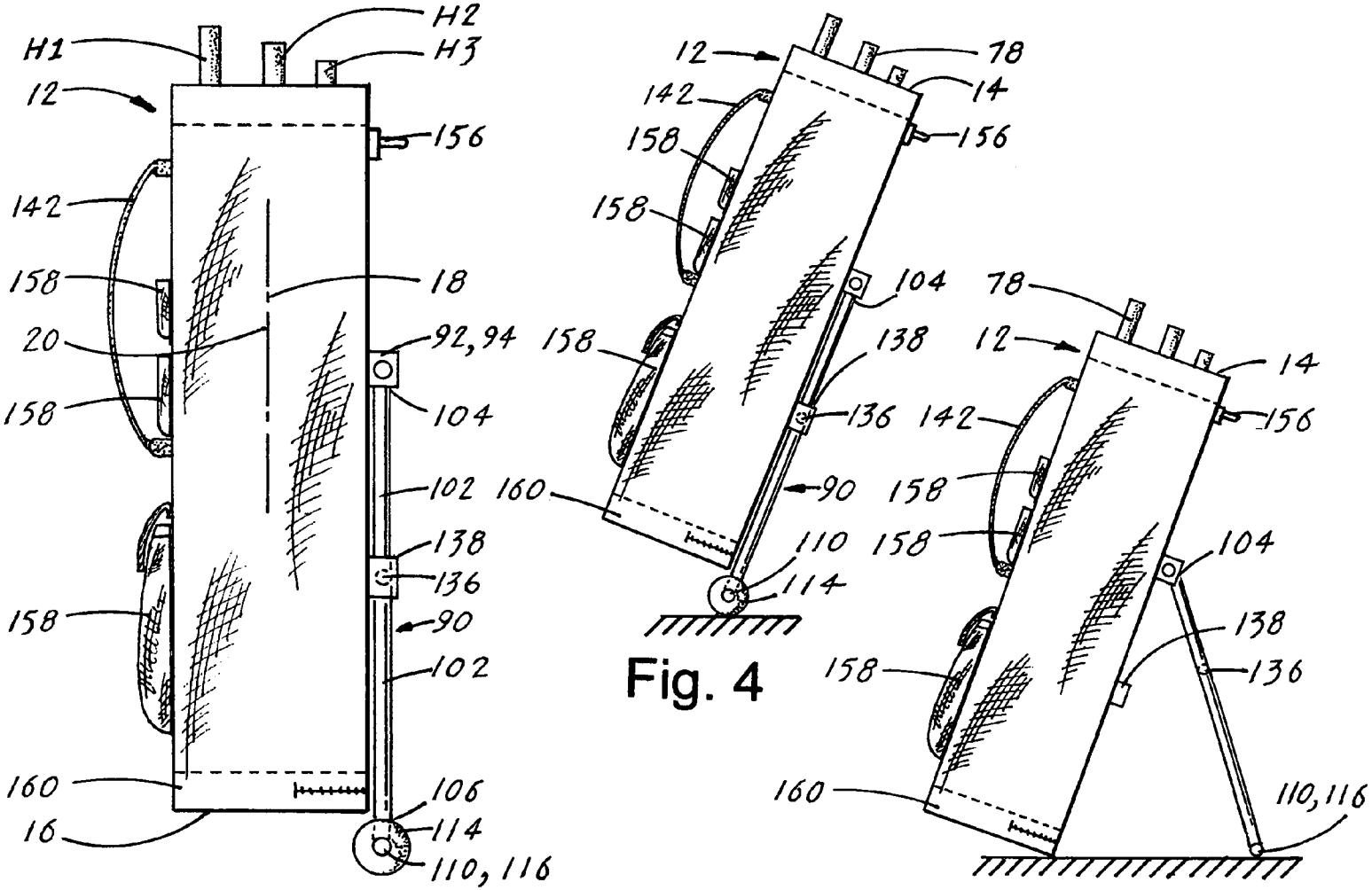
FIG. 3 is an elevational view showing the relative location of the articulated combination golf bag stand and wheel assembly, the handle, the back strap and the plurality of utility pockets.
FIG. 4 is an elevational view showing the golf club bag supported by the combination golf club stand and wheel assembly in a position that allows the golf club bag to be pulled or pushed.
FIG. 5 is an elevational side view showing the golf club bag supported in a stationary position by the combination golf club stand and wheel assembly.

The golf bag 12, as shown in FIGS. 1, 2 and 3, is comprised of an upper opening 14, a lower surface 16, a first side half 18, and a second side half 20. On the first side half 18, as shown in FIGS. 1 and 3, is attached a handle 156 and the articulated, combination golf bag stand and wheel assembly 90. The assembly 90 is further comprised of a centrally located ratchet drive 92 having a right ring ratchet gear 94 and a left ring ratchet gear 96, both of which are well known in the prior art and therefore are not described in detail, a right leg 102, a left leg 120, a lateral leg support member 136, and a lateral clip 138.

The right leg 102 has an upper end 104 and a lower end 106. The upper end 104 has attached a right male ratchet gear 108 that interfaces with the right ring ratchet gear 94, as shown in FIG. 1. The lower end 106 has an outward-extending right axle 110 that has means 112 for receiving an attaching a right wheel 114, as also shown in FIG. 1. When a wheel 114 is not attached, the right axle 110 functions as a right golf bag stand 116.

The left leg 120, as also shown in FIG. 1, has an upper end 122 and a lower end 124. The upper end 122 has attached a left male ratchet gear 126 that interfaces with the left ring ratchet gear 96, as shown in FIG. 1. The lower end 124 has an outward-extending left axle 128 that has means 130 for receiving and attaching a left wheel 132. When a wheel 132 is not attached, the left axle 128 functions as a left golf bag stand 134 in combination with the right golf bag stand 116. To add rigidity and to stabilize the assembly 90, a lateral leg support member 136 is attached between the right leg 102 and the left leg 120, as shown in FIG. 1.

To complete the articulated combination golf bag stand and wheel assembly 90, a lateral clip 138 is attached to the golf bag 12, as also shown in FIGS. 1 and 3. When the combination golf bag stand and wheel assembly 90 is ratcheted inward, the lateral leg support member 136 engages the lateral clip 138 to place the assembly 90 in a stowed configuration, as shown in FIG. 3. In lieu of a lateral clip, a pair of magnetic strips can be utilized to maintain the assembly in the stowed configuration. When the combination golf bag stand and wheel assembly 90 is in the stowed configuration, the golf bag 12 with the wheels 114, 132 attached can be easily rolled or pushed by means of the handle 156, as shown in FIG. 4. Conversely, when the lateral support member 136 is released from the lateral clip 138, the assembly 90 can be extended into an angular configuration which places the golf bag 12 in an angled upright position, as shown in FIG. 5.

On the second side half 20 of the golf club bag 12, as shown in FIG. 2, can be attached a shoulder harness 142 and a plurality of utility pockets 158. The shoulder harness 142 has a right strap 144 having an upper end 146 and a lower end 148, and a left strap 150 having an upper end 152 and a lower end 154. The strap's two upper ends 146,152 are joined and centrally attached to the golf bag 12. The two lower ends 148,154 are spaced apart and attached to the golf bag 12. The utility pockets 158 can be dimensioned to allow various golfing equipment such as golf balls, an umbrella, tees etc. to be inserted. In the lower larger pocket 158 the wheels 114 and 132 as well as a towel can be enclosed.

The golf bag also includes a lower flap 160 that is located adjacent the lower surface 16 of the golf club bag 12 and that is opened and closed by means of a zipper 162. As shown in FIGS. 1, 2 and 3, the flap 160 covers the entire second side half 20 of the golf club bag 12 and a substantial portion of the golf bag's first side half 18. When the lower flap is opened, any debris that enters the golf bag can be easily removed.

Figure 7:
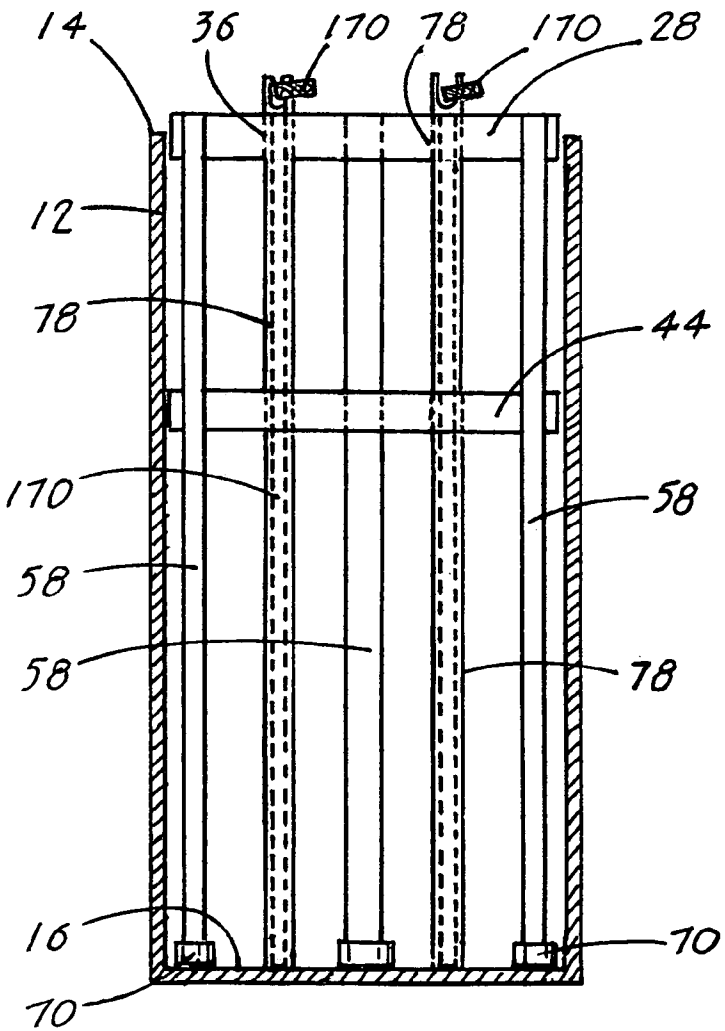
FIG. 7 is a front elevational view of the partitioned golf club insert that is placed into a golf club bag. The view also shows a golf club sleeve inserted into two of the golf club bores.
Figure 6:
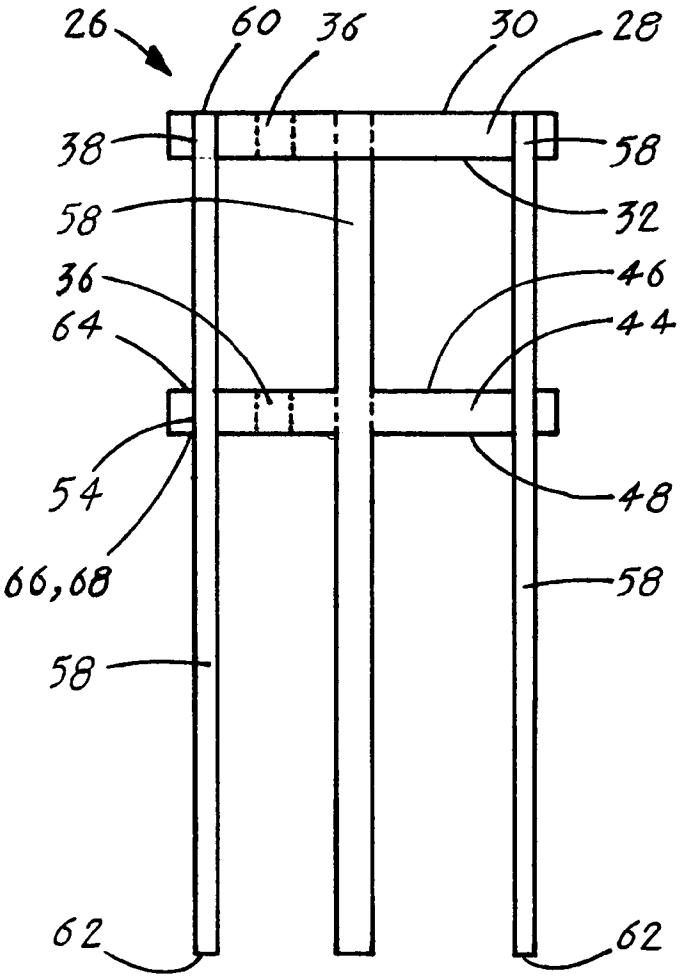
FIG. 6 is a front elevational view of the partitioned golf club insert.
Figure 8:
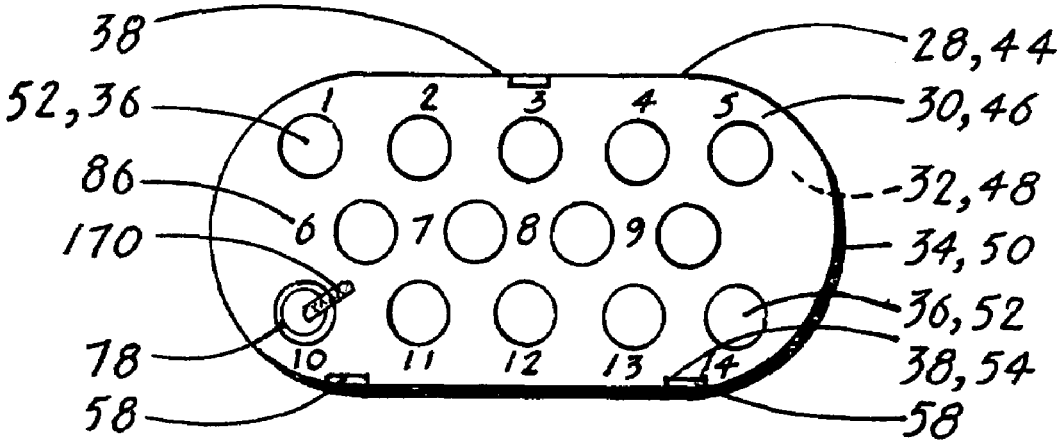
FIG. 8 is a top plan view of an upper partitioned platform showing fourteen golf club bores, a golf club sleeve inserted into one of the golf club bores and a golf club inserted into the sleeve.

The partitioned golf club insert 26, as shown in FIGS. 6, 7 and 8, is comprised of an upper partitioned platform 28, a lower partitioned platform 44, and a set of at least three longitudinal support members 58.

The upper partitioned platform 28 has an upper surface 30, a lower surface 32, a rounded-rectangular shaped perimeter 34, as shown in FIG. 8, a plurality of golf club bores 36, and a set of from three to six evenly-spaced notches 38, with at least three evenly spaced side notches 38 preferred, as best shown in FIG. 8. The golf club bores 36 are each numbered from one to fourteen, as also shown in FIG. 8, and are each dimensioned to accept up to fourteen golf club sleeves 78 and golf clubs 170.

The lower partitioned platform 44 also has a complimentary upper surface 46, a lower surface 48, a rounded-rectangular shaped perimeter 50, a plurality of golf club bores 52 that are in alignment with the golf club bores 36 located on the upper partitioned platform 28, and at least three evenly-spaced side notches 54 that are in alignment with the side notches 38 on the upper partitioned platform 28.

The set of at least three longitudinal support members 58, as shown in FIGS. 6 and 7, each have an upper end 60 and a lower end 62 and are dimensioned to fit into and be attached, by attachment means 64, to the corresponding side notches 38,54 located on the upper and lower partitioned platforms 28,44. The support member attachment means can consist of screws 66 or an adhesive 68.

The upper end 60 of each longitudinal support member 58 is substantially flush with the upper surface 30 of the upper partitioned platform, as shown in FIG. 6. As shown in FIG. 7, the partitioned golf club insert 26 is dimensioned to be inserted into the golf club bag 12, with the upper surface 30 of the upper partitioned platform 28 being substantially flush with the upper opening 14 of the golf club bag 12, as shown in FIG. 7. Each lower end 62 of the longitudinal support members 58 rest upon the lower surface 16 of the golf club bag 12, as also shown in FIG. 7. To protect the lower surface 16 of the golf club bag 12, a resilient insert 70 can be inserted over the lower ends 62 of each longitudinal support member 58, as also shown in FIG. 7. The upper and lower partitioned platform 28,44 and the longitudinal support members 58 are made of a material that can be selected from a group consisting of plastic, wood or metal.

Figure 9:
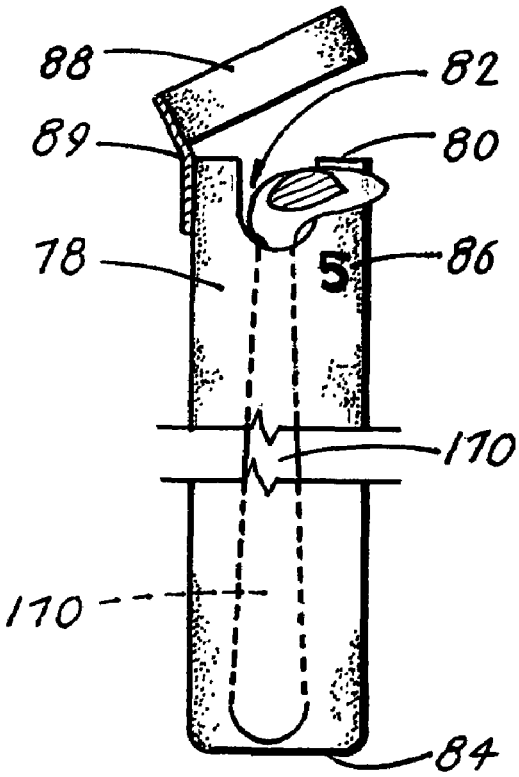
FIG. 9 is a side elevational view of a golf club sleeve showing the location of a vertical notch and a sleeve cap. The view also shows a golf club inserted into the golf club sleeve.

To further protect the golf clubs 170 when inserted into the partitioned golf club insert 26, a golf club sleeve 78, as shown inserted into a golf club bore 36 in FIG. 7, and by itself, in FIG. 9, is utilized. A golf club sleeve 78 is inserted into each of the golf club bores 36,52 that are located respectively on the upper and lower partitioned platforms 28,44. Each sleeve 78 has an upper opening 80 and a lower end 84. The upper opening 80 is located above the upper surface 30 of the upper partitioned platform 28, as shown in FIG. 7. The lower end 84 rests upon the lower surface 16 of the golf club bag 12, as also shown in FIG. 7. As shown in FIGS. 1 and 3, the sleeves 78 are staggered when inserted into the golf club bores 36 on the upper partitioned platform 28. A set of five sleeves 78 are elevated from the upper surface 30 of the upper partitioned platform at a height of H1, a set of four sleeves are elevated at a height of H2, and a set of five sleeves are elevated at a height of H3. As shown in FIG. 3, the height H2 is less than the height of H1, and the height of H3 is less than the height of H2. The staggered heights allow a golfer to easily view and select a particular golf club 170.

As shown best in FIG. 9, the golf club sleeve 78 also includes a vertical notch 82 that extends from the upper sleeve's opening 80. The notch 82 allows the head of an inserted golf club 170 to be maintained in a particular angular position, as shown in FIGS. 8 and 9. Additionally, as shown in FIG. 9, a sleeve cap 88 is attached by means of a cap strap 89 to a side of each golf club sleeve 78. The cap 88 is dimensioned to frictionally fit over the upper opening 80 of the golf club sleeve 78 when a golf club 170 is not inserted into the sleeve 78. The golf club sleeve 78 can also be numbered from one to fourteen. Each number is printed adjacent to its respective upper opening 80 on the sleeve 78, as shown in FIG. 9. The sleeve number 86 corresponds to the number of the golf club bores 36 printed on the upper surface of the upper partitioned platform 28. The sleeve 78 can be made of a material selected from the group consisting of plastic, wood, metal and cloth.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and cope of the claims.

The invention claimed is:

1. A partitioned golf club bag comprising:

a) said golf club bag having:
- (1) an upper opening,
- (2) a lower surface,
- (3) a first side half, and
- (4) a second side half, b) a partitioned golf club insert comprising:
- (1) an upper partitioned platform having:
  - (a) an upper surface,
  - (b) a lower surface,
  - (c) a rounded-rectangular shaped perimeter,
  - (d) a plurality of golf club bores,
  - (e) at least three evenly-spaced side notches,
- (2) a lower partitioned platform having:
  - (a) an upper surface,
  - (b) a lower surface,
  - (c) a rounded-rectangular shaped perimeter,
  - (d) a plurality of golf club bores that are in alignment with the golf club bores located on the upper partitioned platform,
  - (e) at least three evenly-spaced side notches that are in alignment with the notches on the upper partitioned platform,
- (3) a set of at least three longitudinal support members each having:
  - (a) an upper end and a lower end, wherein each support member is dimensioned to fit into each corresponding side notch located on the upper and lower partitioned platforms and means for being attached to the upper and lower platforms, wherein the upper end of each longitudinal support member is substantially flush with the upper surface of the upper partitioned platform, wherein said partitioned golf club insert is dimensioned to be inserted into said golf club bag, with the upper surface of the upper partitioned platform being substantially flush with the upper opening of said golf club bag, and with each lower end of the longitudinal support members resting upon the lower surface of said golf club bag, b) a golf club sleeve that is inserted into each of the golf club bores located on the upper and lower partitioned platforms, wherein each sleeve having:

(1) an upper opening that is located above the upper surface of the upper partitioned platform, the upper opening on each said golf club sleeve further having a vertical notch that allows the head of an inserted golf club to be maintained in a particular angular position, said sleeves are staggered when inserted into the bores located on the upper partitioned platform, wherein a set of five sleeves are elevated from the upper surface of the upper partitioned platform at a height H1, a set of four said sleeves are elevated at a height H2, and a set of five said sleeves are elevated at a height H3, wherein the height of H2 is less than the height of H1, and the height of H3 is less than the height of H2, and (2) a lower end that rests upon the lower surface of said golf club bag.

2. The partitioned golf club bag as specified in claim 1 further comprising a number from one to fourteen that is printed adjacent the upper opening of said golf club sleeve, wherein the number corresponds to the number of the golf club bores printed on the upper surface of said upper partitioned platform.

3. The partitioned golf club bag as specified in claim 2 further comprising a cap having a strap that is attached to a side of each said golf club sleeve, wherein the cap is dimensioned to frictionally fit over the upper opening of said sleeve when a golf club is not inserted into said sleeve.

4. The partitioned golf club bag as specified in claim 3 wherein the material of said golf club sleeve is selected of a material selected from the group consisting of plastic, wood, metal and cloth.

5. The partitioned golf club bag as specified in claim 1 wherein said upper and lower partitioned platforms are made of a material selected from the group consisting of plastic, wood and metal.

6. The partitioned golf club bag as specified in claim 5 wherein said plurality of golf club bores are comprised of fourteen golf club bores.

7. The partitioned golf club bag as specified in claim 6 wherein each said bore is numbered from one to fourteen.

8. The partitioned golf club bag as specified in claim 1 wherein said side notches range from a minimum of three evenly-spaced notches to six evenly-spaced notches.

9. The partitioned golf club bag as specified in claim 1 wherein said longitudinal support members are made of a material selected from the group consisting of plastic, wood or metal.

10. The partitioned golf club bag as specified in claim 9 further comprising a resilient insert that is inserted over the lower ends of each said longitudinal support member.

* * * * *